United States Patent [19]

Maitland

[11] Patent Number: 4,915,798

[45] Date of Patent: Apr. 10, 1990

[54] CORROSION RESISTANT ALUMINUM PRODUCT WITH UNIFORMLY GREY, LIGHT-FAST SURFACE AND PROCESS FOR ITS MANUFACTURE

[75] Inventor: Alexander Maitland, Schaffhausen, Switzerland

[73] Assignee: Intevep, S.A., Caraacas, Venezuela

[21] Appl. No.: 107,772

[22] Filed: Oct. 13, 1987

[51] Int. Cl.[4] ..... C25D 11/04

[52] U.S. Cl. ..... 204/29; 148/3; 204/33; 420/451; 428/469

[58] Field of Search ..... 420/551; 148/3, 13, 148/437, 438, 439, 440; 204/33, 29; 428/469

[56] References Cited

U.S. PATENT DOCUMENTS

| | | | |
|---|---|---|---|
| 3,938,991 | 2/1976 | Sperry et al. | 75/143 |
| 4,672,022 | 6/1987 | Reiss et al. | 430/278 |
| 4,806,211 | 2/1989 | Timm et al. | 204/29 |

*Primary Examiner*—John F. Niebling
*Assistant Examiner*—William T. Leader
*Attorney, Agent, or Firm*—Bachman & La Pointe

[57] ABSTRACT

The present invention relates to an aluminum alloy containing vanadium characterized by improved corrosion resistance and articles made therefrom wherein said articles when anodized have a uniformly grey, light-fast surface and a reflectivity of at most 50%.

8 Claims, No Drawings

CORROSION RESISTANT ALUMINUM PRODUCT WITH UNIFORMLY GREY, LIGHT-FAST SURFACE AND PROCESS FOR ITS MANUFACTURE

BACKGROUND OF THE INVENTION

The present invention relates to an aluminum alloy containing vanadium characterized by improved corrosion resistance and articles made therefrom wherein said articles when anodized have a uniformly grey, light-fast surface and a reflectivity of at most 50%.

The alloy of the present invention consists essentially of 1.20 to 1.60 wt. % iron; 0.25 to 0.55 wt. % manganese; 0.05 to 0.25 wt. % vanadium; up to 0.20 wt. % silicon; up to 0.30 wt. % copper; up to 5.0 wt. % magnesium; up to 0.10 wt. % chromium; up to 2.0 wt. % zinc; up to 0.25 wt. % zirconium; up to 0.10 wt. % titanium; up to 0.50 wt. % total impurities; and the balance aluminum. The present invention includes a method for producing an aluminum article from the alloy set forth above having the characteristics mentioned hereinabove.

Heretofore, various processes are known for achieving a decorative grey color tone on aluminum alloy products These processes are based on the anodic oxidation of the surface of the aluminum alloy products and do not require additional absorptive coloring. The quality of the resultant color tone and its characteristics are determined by a number of process parameters including particularly the composition of the electrolyte, the voltage applied, the type of electrical current, density and duration and the composition of the particular alloy being employed.

It is common in the prior art to employ two-stage electrocoloring processes and many of these processes are known in the prior art. Classically, in the first stage of the two-stage coloring process, an oxide layer of about 20 μm thick is produced in a sulfuric acid or a sulfuric acid/oxalic acid electrolyte using direct current having a current density of 100 to 200 A/m$^2$. Following the first stage oxidation, the second stage employs alternating current at a current density of between 10 to 100 A/m$^2$ in a metal salt solution of desired composition. During the second stage, the metal compounds are precipitated out of the metal salt solution and deposited on the oxide layer such that the metal compounds adhere to the base of the portion in the oxide layer thus forming a permanent light-fast coloring of the oxide.

In addition to the multi-stage coloring processes of the prior art as noted above, a further group of processes for producing light-fast grey tone finishes employ a single stage color anodizing wherein direct current at a current density of 70 to 800 A/m$^2$ is applied in a special electrolyte to produce oxide layers of natural self-color tone. The color tone obtained in this single stage color anodizing process is dependent on the composition of the alloy and on the electrolyte which comprises organic acids and, if desired, additions of sulfuric acids. Typical aluminum alloys used in this process are aluminum alloys of the type aluminum-manganese, aluminum-magnesium and aluminum-magnesium-silicon alloys.

In addition to the foregoing processes, by employing selected alloys and special processing procedures in the production of semi-finished aluminum articles, it is possible to obtain decorative grey tones on the products with standard anodizing processes. These widely known standard anodizing processes which are very cost attractive, employ direct current at a current density of 80 to 300 A/m$^2$ and make use of a sulfuric acid electrolyte which often contains additions of carbonic acid. To date, aluminum alloys selected for these anodizing processes contain 4.5 wt. % silicon and 0.5 wt. % magnesium. By using a current density of 150 A/m$^2$ when anodizing the foregoing aluminum alloy, one obtains after 40 minutes of treatment an oxide layer which is about 18 μm thick and exhibits a moderately grey color tone. The light reflectivity, as a measure of grey tone, amounts to 20%. After an oxidation time of 60 minutes, the oxide layer is 27 μm thick and exhibits a dark grey, self-color finish having a light reflectivity of 13%. The light reflectivity is measured in each case using a LANGE UME 1-LFE 1-measuring instrument.

It has been found that the foregoing aluminum alloy when used in the production of semi-finished products tends to excessively wear the shaping tools used in the production of the semi-finished article. In addition, it has been found difficult to maintain close tolerances in terms of color tone and uniformity.

Accordingly, it is the principal object of the present invention to develop a corrosion resistant aluminum alloy for the production of aluminum products.

It is a particular object of the present invention to develop anodized aluminum articles from said alloy wherein the surface reflectivity of the alloy is uniform.

It is a further object of the present invention to provide a method for producing an improved aluminum article having superior surface qualities than that obtained using conventional processes without the need of additional coloring steps.

Further objects and advantages of the present invention will appear hereinbelow.

SUMMARY OF THE INVENTION

In accordance with the present invention the foregoing objects and advantages are readily obtained.

The invention relates to a method for producing improved aluminum articles from a novel aluminum alloy composition having positive additions of vanadium wherein the aluminum article in the anodized state is characterized by a uniformly grey, light-fast surface and a light reflectivity when compared to an unanodized article of like composition of at most 50% as measured using a LANGE UME 1-LFE 1-measuring instrument.

DETAILED DESCRIPTION

The present invention relates to a vanadium containing aluminum alloy characterized by improved corrosion resistance. In accordance with the present invention an aluminum alloy used to produce aluminum articles in accordance with the method of the present invention consists essentially of 1.20 to 1.60 wt. % iron; 0.25 to 0.55 wt. % manganese; 0.05 to 0.25 wt. % vanadium; up to 0.20 wt. % silicon; up to 0.30 wt. % copper; up to 5.0 wt. % magnesium; up to 0.10 wt. % chromium; up to 2.0 wt. % zinc; up to 0.25 wt. % zirconium; up to 0.10 wt. % titanium; up to 0.50 wt. % total impurities; and the balance aluminum. The preferred alloy composition has a vanadium content of from 0.10 to 0.20 wt. %; an iron content of from 1.30 to 1.50 wt. %; a silicon content below 0.08 wt. %; and a weight ratio of iron to manganese which ranges from 3.0 to 4.0:1. The corrosion resistance of the alloy of the present invention compared to like alloys without positive additions of vanadium is markedly improved.

In order to obtain the desired light reflectivity characteristics in aluminum articles produced from the alloy composition of the present invention, it is necessary to control various processing steps during the production of the aluminum article from the alloy composition. In accordance with the present invention the method for producing an aluminum article having a uniformly grey, light-fast surface and a light reflectivity of at most 50% in the anodized state comprises processing the aluminum alloy of the present invention as set forth above from the casting stage to the article stag at processing temperatures of no more than 560° C. wherein the duration of processing at temperature between 540° to 560° C. is not greater than 4 hours. The aluminum article so processed is thereafter anodized in an electrolyte using direct current in a sulfuric acid electrolyte containing 10 to 25 wt. % sulfuric acid and up to 5 wt. % carbonic acid. It is preferred in accordance with the method of the present invention that all heat treatment temperatures, including temperatures relating to hot forming processes and those preceding hot forming are in the lowest possible temperature ranges and that the duration for temperatures above 300° C. be kept to as short as possible.

The anodized aluminum article produced from the alloy composition of the present invention and the method of the present invention yields an article having an oxide layer whose light reflectivity when compared to an unanodized article of like composition is between 8 to 45% with oxide layer thicknesses of between 5 to 30 μm and below 30 wt. % with oxide thicknesses of about 10 μm.

Further advantages, characteristics and details of the present invention will be apparent from the following description of preferred examples.

EXAMPLE 1

A rectangular strand measuring 320×1080mm² in cross-section was cast in an alloy containing 1.44% iron, 0.38% manganese, 0.06% silicon, 0.12% vanadium, the remainder aluminum and 0.07% impurities. The conventionally cast ingot was scalped on both sides to a depth of 10 mm. If hot-top or magnetic mold casting is employed, the scalping could be omitted. The slab was then heated to 520° C. and, without holding at temperature, transferred to a hot rolling mill and rolled to an 8 mm thick plate. The said plate emerging from the mill at 450° C. was passed through a water bath, then cold rolled down to a thickness of 1.0 mm. After a final anneal of 3 hours at 320° C., the sheet exhibited an ultimate tensile strength $R_m$ of 137 MPa, a 0.2% proof stress $R_{p0.2}$ of 108 MPa and an elongation $A_5$ of 42%.

Sheets measuring 980×980mm² were anodized in an electrolyte. The bath contained 180 g sulfuric acid and 10 g oxalic acid per liter. The density of the direct-current was 150 A/m². The oxide layer exhibited a uniform, mid-grey color over the whole surface. The light reflectivity measured, using the LANGE UME 1-LFE 1 device, amounted to 16%. Sheets anodized for 40 minutes exhibited an oxide layer thickness of 20 μm; the light reflectivity of the uniform, dark grey surface was 10%.

EXAMPLE 2

A round ingot, 200 mm in diameter, was cast in an alloy containing 1.43% iron, 0.41% manganese, 0.12% vanadium, 0.15% zirconium, 0.05% silicon, the remainder aluminum with 0.06% impurities. The ingot was machined to a depth of 2 mm around its circumference. It was then heated quickly to 490° C. for extrusion and without delay extruded to three sections each having a cross-section of 140 mm². The extruded strands, which contained extrusion welds, emerged from the die at a temperature of 540° C. and were cooled with forced air cooling. Tensile testing showed the tensile strength $R_m$ to be 155 MPa and the 0.2% proof stress $R_{p0.2}$ to be 88 MPa.

Extrusion lengths were anodized in a bath containing 180 g sulfuric acid and 10 g oxalic acid per liter using a direct-current with current density of 200 A/m². After 13 minutes treatment, the oxide was 9 μm thick. The reflectivity was 17%. All three sections exhibited a uniform, structure-free, mid-grey color. There were no color differences apparent.

EXAMPLE 3

A round ingot, 160 mm in diameter, was cast in an alloy containing 1.46% iron, 0.38% manganese, 1.2% magnesium, 0.05% silicon, the remainder aluminum with 0.05% impurities. The ingot was machined to a depth of 3 mm at its circumference, heated quickly to 380° C. for extrusion and after holding at temperature for one hour was extruded to a rectangular section of 4×30mm² at a speed of 16 m/min. The extruded strand emerged from the die at a temperature of 460° C. and was cooled in the air. The tensile strength $R_m$ was 220 MPa, the 0.2% proof stress $R_{p0.2}$ was 112 MPa and the elongation at fracture $A_5$ was 19%. After stretching 3%, the $R_m$ value was 225 MPa, $R_{p0.2}$ was 188 MPa and $A_5$ was 18%.

Lengths of the extrusion were anodized in a bath containing 180 g sulfuric acid and 10 g oxalic acid per liter using a direct-current of current density 150 A/m². After 25 minutes of treatment, the oxide layer was 12 μm thick. The reflectivity was 15%.

EXAMPLE 4

Four test samples having the following alloy compositions were prepared.

| | |
|---|---|
| (1) | 1.4 wt. % iron |
| | 0.11 wt. % silicon |
| | 0.41 wt. % manganese |
| | 0.003% vanadium |
| | balance essentially aluminum |
| (2) | 1.4 wt. % iron |
| | 0.11 wt. % silicon |
| | 0.41 wt. % manganese |
| | 0.053% vanadium |
| | balance essentially aluminum |
| (3) | 1.4 wt. % iron |
| | 0.11 wt. % silicon |
| | 0.41 wt. % manganese |
| | 0.102% vanadium |
| | balance essentially aluminum |
| (4) | 1.4 wt. % iron |
| | 0.11 wt. % silicon |
| | 0.41 wt. % manganese |
| | 0.152% vanadium |
| | balance essentially aluminum |

After casting, scalping, homogenizing and hot and cold rolling the samples were in the form of 1 mm thick sheets. These samples were then annealed at a temperature of 400° C. to return to the soft condition. Thereafter, the samples were subjected to a brief caustic pickling and immersed in an aqueous solution of 3% sodium chloride plus 1% hydrogen chloride for 2 hours in order to determine the corrosion resistance characteristics of the alloys. This test, called the Zeerleder-Zurbrugg test is a common method for testing corrosion resistance of aluminum alloys.

The results of the tests are set forth below in Table I.

TABLE I

| Zeerleder-Zurbrugg Test | |
|---|---|
| Sample No. | $H_2$ evolved ($cm^3$) |
| G1 | 14.82 ± 2.13 |
| G2 | 10.71 ± 1.72 |
| G3 | 8.01 ± 1.08 |
| G4 | 6.2 ± 0.28 |

It can be seen that the degree of attack on the aluminum alloys is markedly reduced as the vanadium content of the alloy increases.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method of producing an improved aluminum article having uniformly grey, light-fast surface and a light reflectivity of at most 50% in the anodized state comprising the steps of:

(a) providing an aluminum alloy consisting essentially of 1.20 to 1.60 wt. % iron; 0.25 to 0.55 wt. % manganese; 0.10 to 0.20 wt. % vanadium; up to 0.20 wt. % silicon; up to 0.30 wt. % copper; up to 5.0 wt. % magnesium; up to 0.10 wt. % chromium; up to 2.0 wt. % zinc; up to 0.25 wt. % zirconium; up to 0.10 wt. % titanium; up to 0.50 wt. % total impurities; and the balance aluminum;

(b) casting said alloy;

(c) processing said cast alloy from the casting stage to the article stage at processing temperatures of no more than 560° C. wherein the duration of processing at temperatures between 540° to 560° C. is not greater than 4 hours; and (d) anodizing said processed aluminum article.

2. A method according to claim 1 wherein the iron content is from 1.30 to 1.50 wt. %; the silicon content is below 0.08 wt. % and the weight ratio of iron to manganese falls within the range of 3.0 to 4.0:1.

3. A method according to claim 1 including anodizing the cast alloy using direct current in a sulfuric acid electrolyte containing 10 to 25 wt. % sulfuric acid and up to 5 wt. % carbonic acid.

4. A method according to claim 3 wherein the iron content is from 1.30 to 1.50 wt. %; the silicon content is below 0.08 wt. % and the weight ratio of iron to manganese falls within the range of 3.0 to 4.0:1.

5. An aluminum article produced by the method of claim 1.

6. An anodized aluminum article having an oxide layer formed thereon, said article being formed from an aluminum alloy having the following chemical composition 1.20 to 1.60 wt. % iron;
0.25 to 0.55 wt. % manganese;
0.10 to 0.20 wt. % vanadium;
up to 0.20 wt. % silicon;
up to 0.30 wt. % copper;
up to 5.0 wt. % magnesium;
up to 0.10 wt. % chromium;
up to 2.0 wt. % zinc;
up to 0.25 wt. % zirconium;
up to 0.10 wt. % titanium;
up to 0.50 wt. % total impurities;
and the balance aluminum;

wherein the anodized article has a uniformly grey, light-fast surface and a light reflectivity of at most 50%.

7. An anodized aluminum article according to claim 6 wherein the oxide layer has a thickness of 5 to 30 μm and the light reflectivity of the oxide layer when compared to an unanodized article of like composition is between 8 to 45%.

8. An anodized aluminum article according to claim 6 wherein the oxide layer has a thickness of about 10 um and the light reflectivity of the oxide layer when compared to an unanodized article of like composition is less than 30%.

* * * * *